US005108068A

United States Patent [19]

Gingras

[11] Patent Number: 5,108,068

[45] Date of Patent: Apr. 28, 1992

[54] SUPPORT SYSTEM FOR FREE STANDING POLES OR POSTS

[76] Inventor: Marc M. Gingras, R.R. #1, B.G. #28, Val D'Or, Québec, Canada, J9P 4N7

[21] Appl. No.: 465,352

[22] Filed: Jan. 16, 1990

[30] Foreign Application Priority Data

Aug. 30, 1989 [CA] Canada ..... 609837

[51] Int. Cl.[5] ..... F16M 13/00

[52] U.S. Cl. ..... 248/545; 52/160; 52/161

[58] Field of Search ..... 248/545; 52/160, 161, 52/162, 155, 170, 163, 742

[56] References Cited

U.S. PATENT DOCUMENTS

| | | | |
|---|---|---|---|
| 177,946 | 4/1916 | Ferguson . | |
| 3,924,371 | 12/1975 | Kidwell | 52/161 |
| 3,974,604 | 8/1976 | Conn et al. | 52/160 |
| 4,189,879 | 1/1980 | Patterson | 52/161 |
| 4,269,010 | 5/1981 | Glass | 52/154 |
| 4,547,106 | 10/1985 | Lipsker | 52/160 X |
| 4,633,902 | 5/1987 | Abbott, Jr. | 52/155 |
| 4,644,712 | 2/1987 | Watson | 52/162 |
| 4,843,785 | 7/1989 | Sero et al. | 52/160 |
| 4,850,565 | 7/1989 | Moreno . | |

FOREIGN PATENT DOCUMENTS

| | | |
|---|---|---|
| 177946 | 7/1917 | Canada . |
| 970583 | 7/1975 | Canada . |
| 1003229 | 4/1977 | Canada . |

*Primary Examiner*—Carl D. Friedman
*Assistant Examiner*—Korie H. Chan
*Attorney, Agent, or Firm*—Jones, Tullar & Cooper

[57] ABSTRACT

The invention relates to a method for installing subterranean supports for structures such as poles, posts and the like, and an apparatus therefor, which will permit such structures to stand free of any stays or guy wires and their associated anchors. The system comprises a support and an instrument for the installation of the support. The support preferably includes an upper and a lower collar assembly, each comprising a collar and a plurality of ground engageable blades pivotally connected thereto. In general, the collar assemblies are lowered into a hole in the ground and the installation instrument is utilized to extend the blades of the collars in a generally radial direction, causing the blades to penetrate the walls of the hole and thus securing the support therein.

22 Claims, 8 Drawing Sheets

SUPPORT SYSTEM FOR FREE STANDING POLES OR POSTS

BACKGROUND OF THE INVENTION

1. Field of the Invention

The present invention relates to supports for partially embedded poles, posts, and the like, and in particular, to an installation system which will permit such structures to stand free of any stays or guy wires and their associated anchors.

2. Prior Art

When partially embedded poles or posts are required to withstand vertical loading as well as lateral or horizontal forces, for example from cables, conductors, ice and wind, guy wires or stays are typically used to resist these forces and to support the poles. However, the use of stays or guy wires present some serious drawbacks: supports of this type require wide areas for anchorage and thus, there is considerable loss of usable land; they are unsightly, especially in urban areas where they are in heavy use; and the numerous and large excavations required for anchor installation causes damage to the environment and to public and private property.

Also associated with the use of guy wire supports are high costs which arise from the acquisitions of public and private legal permission for their installation, the necessity of using alternate routes when guy wire anchorage of a pole is not permitted or possible in a chosen location, landscaping costs for reparations to property damaged by excavations, and costs for the numerous excavations themselves.

The use of guy wire supports also increases the possibility of the pole sustaining damage and, hence, the equipment supported by it, in the event of a collision with the guy wire. Such an event could result in power blackouts, loss of street lighting, interruption of telephone and cable television service, and the loss of other public and private services.

Other methods and apparatuses for providing support for embedded poles and posts have been devised such as the anchor system shown and described in the U.S. Pat. No. 4,269,010. The system comprises a plurality of anchors each having a tubular main sleeve designed to engage the post. A disc member extends horizontally from a midlength position on the sleeve and upper and lower radial fin members extend from the sleeve to the outer circumference of the disc, being rigidly attached thereto.

In using such a system, it is necessary to form a hole in the ground having a diameter similar to that of the anchor, which is substantially greater than the diameter of the pole or post. For poles of a large diameter, the excavation of a substantially greater diameter hole may not be feasible. In addition, the backfill material adjacent the pole and above and below the anchors, even if compacted, may not attain the compactness of that of the surrounding earth and, therefore, may not be capable of providing the resistance necessary to withstand the forces which act on the pole.

SUMMARY OF THE INVENTION

The present invention overcomes the aforementioned drawbacks by providing a support system which will permit pole or post structures to stand free of any stays or guy wires and their associated anchors.

Accordingly, there is provided a support installation system for the support of partially embedded poles or posts which is comprised of a support and the installation instrument therefor. The support includes a lower and an upper collar assembly, each comprising a collar and a plurality of ground engageable blades pivotally connected thereto. The installation instrument has a means to extend the blades of the collars in a generally radial direction.

According to a second aspect of the invention, there is provided a method for the installation of underground supports for poles and posts of the type including an upper and a lower collar assembly, each of which comprises a collar having a plurality of ground engageable blades pivotally connected thereto. A hole of predetermined depth and diameter is drilled into the earth into which an installation instrument is inserted. The installation instrument has associated therewith, means to extend generally radially the blades of the collar assemblies by rotation of the instrument. The lower collar assembly is lowered into the hole and the installation instrument is rotated to extend the blades of the lower collar into the earth. Similarly, the upper collar assembly is lowered into the hole and its blades are extended by rotation of the installation instrument. The installation instrument is then removed, leaving the support firmly embedded. The pole or post may then be subsequently installed within the support being positioned and aligned as required.

In using this support system, no excavation of the pole's location is required other than a hole slightly larger than the diameter of the pole, drilled to plant the pole or post in the ground using standard drilling methods now in use. It requires no additional capital investment for existing pole installation equipment. No specialized training is required by the workers or by engineers using this support system in pole structure design. If ever it becomes necessary to remove or relocate the pole, both the pole and the support can be easily removed and reused in another location.

Further features and advantages of the invention will become more apparent from the following description of the preferred embodiment when taken in connection with the accompanying drawings.

DESCRIPTION OF THE PREFERRED EMBODIMENT

Figure 1:
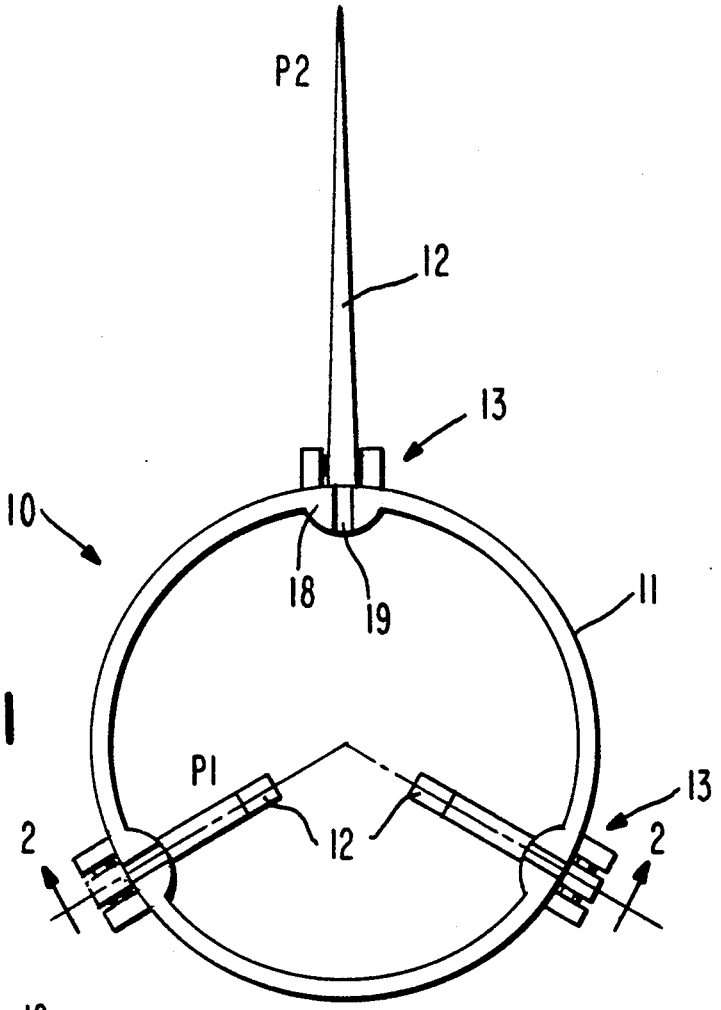
FIG. 1 is a plan view of a collar assembly.
Figure 2:
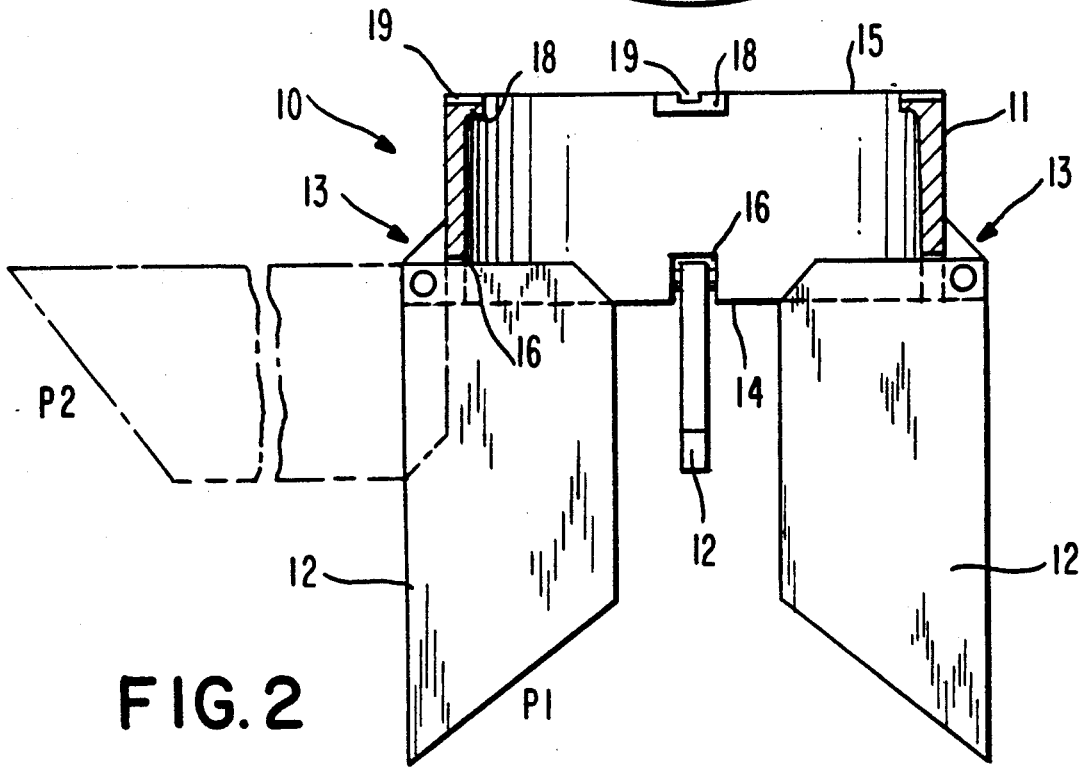
FIG. 2 is a cross-sectional side elevation of the collar assembly shown in FIG. 1 along section lines 2—2.

Referring to FIGS. 1 and 2, collar assembly 10 is shown comprising a generally cylindrical collar 11 and a plurality of ground-engageable blades 12 connected pivotally thereto by hinge means 13. The blades 12 are spaced at relatively equal intervals along the outer periphery at one end 14 of collar 11. The blades 12 are rotatable about hinge means 13 from an installation position P1, wherein the blades are generally parallel to the longitudinal axis of the collar, to a deployed position P2, wherein the blades are generally perpendicular to the longitudinal axis of the collar. The blades 12 may be as numerous as desired, although three are shown, and they may be of any suitable shape or style. Depending on the configuration of blade 12, it may be necessary to cut suitable slots 16 in the collar 11 to permit a portion of the blade 12 to be received therein when the blade 12 is in its installation position P1.

At the opposite end 15 of collar 11, there is a plurality of inwardly extending tabs 18 having radial slots 19 therein. The purpose of these tabs will be explained hereinafter.

Figure 3:
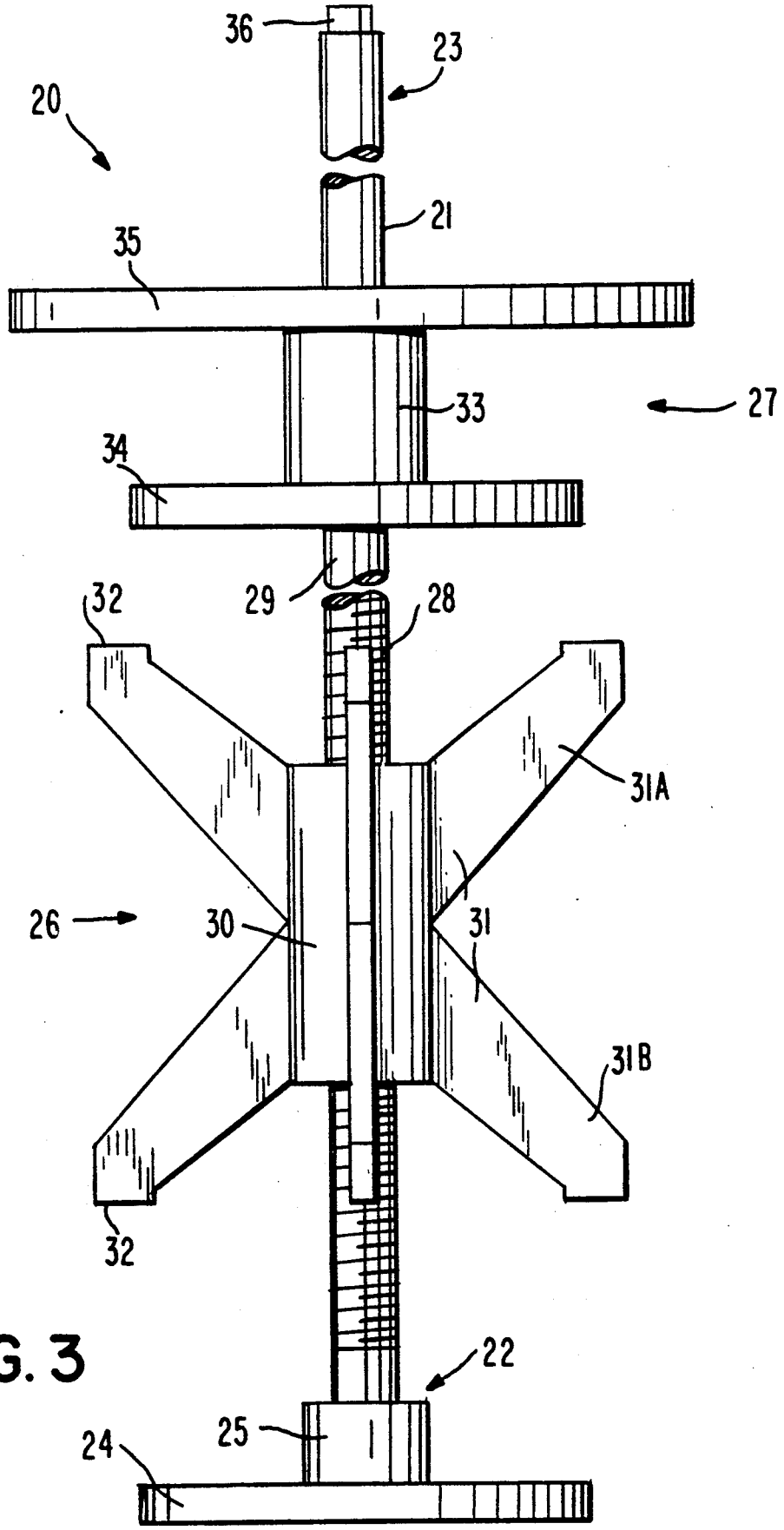
FIG. 3 is a side elevation illustrating the installation instrument of the preferred embodiment.
Figure 4:
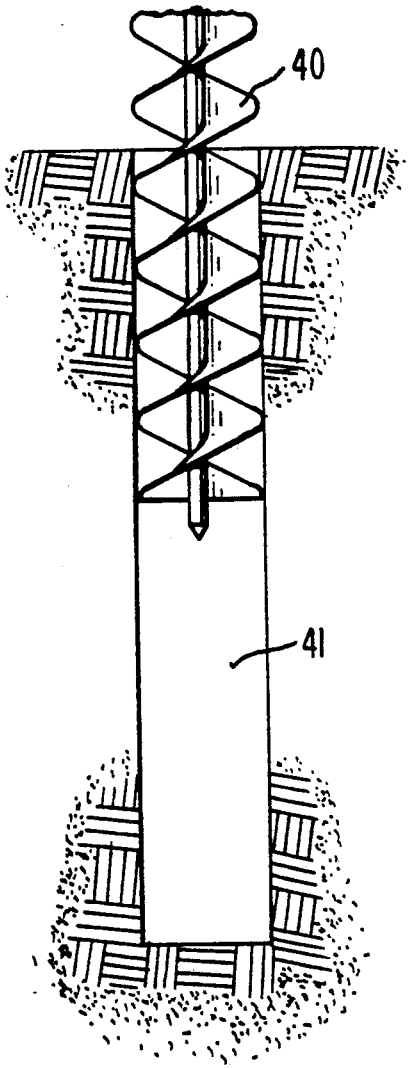
FIGS. 4 through 11 are various views which sequentially illustrate a method of installing the pole support.
Figure 5:
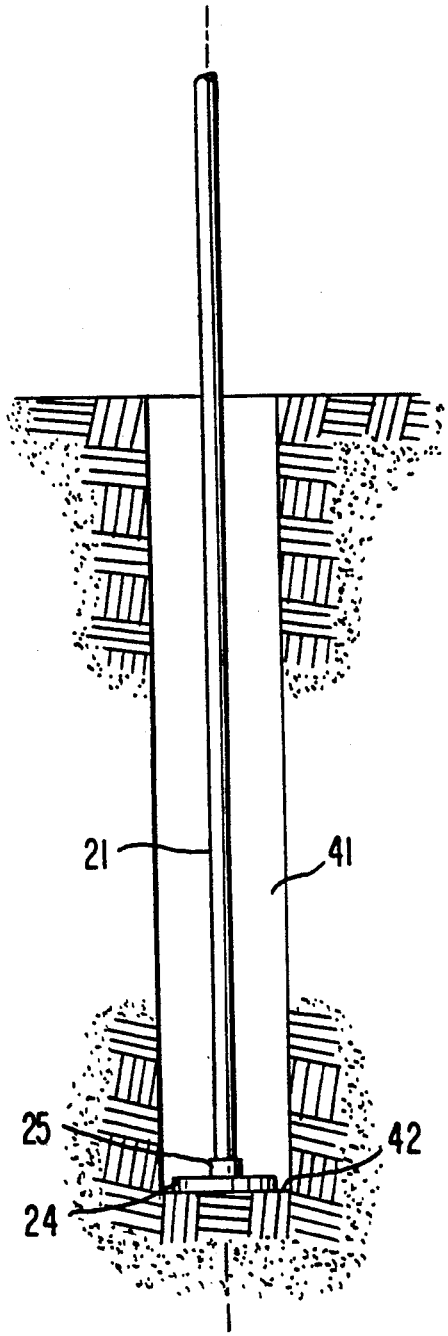

The installation instrument 20 is shown in FIG. 3 and comprises a partially threaded deployment shaft 21 having at its lower end 22 a lower camming plate 24 and a camming plate bearing assembly 25. The installation instrument 20 further includes a blade actuating device 26 and a camming means such as upper camming plate assembly 27.

In its preferred embodiment, the blade actuating device 26 is comprised of a plurality of radially spaced finger pairs 31 rigidly attached to a cylindrical body member 30. Body member 30 is hollow and has internal threads designed to engage with the threaded portion 28 of the deployment shaft 21. The diameter of threaded portion 28 is slightly greater than the diameter of the unthreaded portion 29, allowing the blade actuating device 26 to slide over the unthreaded portion 29 of the deployment shaft 21. Each pair of fingers 31 consists of an upwardly and outwardly extending finger 31A and a downwardly and outwardly extending finger 31B. The radial distance to which the fingers 31A, 31B extend is slightly less than the inner diameter of the collar 11 and sufficient as to permit the tips 32 of the fingers 31A or 31B to engage in a portion of the corresponding slots 19 of the inwardly extending tabs 18.

In order to remove dirt and other particulate matter which might accumulate on the threaded portion 28 of the shaft 21 and/or to prevent any such material from entering the blade actuating device 26 and jamming the screw action, it may be necessary to provide a seal, packing or similar device (not shown) at the upper and lower ends thereof.

The upper camming plate assembly 27 preferably comprises a hollow cylindrical body portion 33 separating an upper camming plate 34 and a collar bearing plate 35. A locking mechanism, not shown, is located within the body portion 33, and may be of the type which permits only unidirectional downward motion of the upper camming plate assembly 27 on the unthreaded portion 29 of the deployment shaft 21 unless deactivated. Other suitable locking mechanisms may be used such as, for example, a spring loaded pin or ring situated in the body portion 33 which would lock into a corresponding groove in the shaft 21 when the upper camming plate assembly 27 is slid down its unthreaded portion 29. The locking mechanism allows the upper camming plate assembly 27 to be locked into position on the unthreaded portion 29 of the deployment shaft 21 at a predetermined height, preventing its translation but allowing its rotation relative to the shaft 21.

At the upper end 23 of the deployment shaft 21, a means 36 is provided by which the shaft may be rotated manually or with power assistance.

While the preferred embodiment of the support is shown and described herein comprising an upper and lower collar assembly, the invention is not necessarily limited thereto. For example, depending on the specific application, any number of collar assemblies may be employed, provided that the installation instrument and its associated components are suitably adapted.

Figure 6:
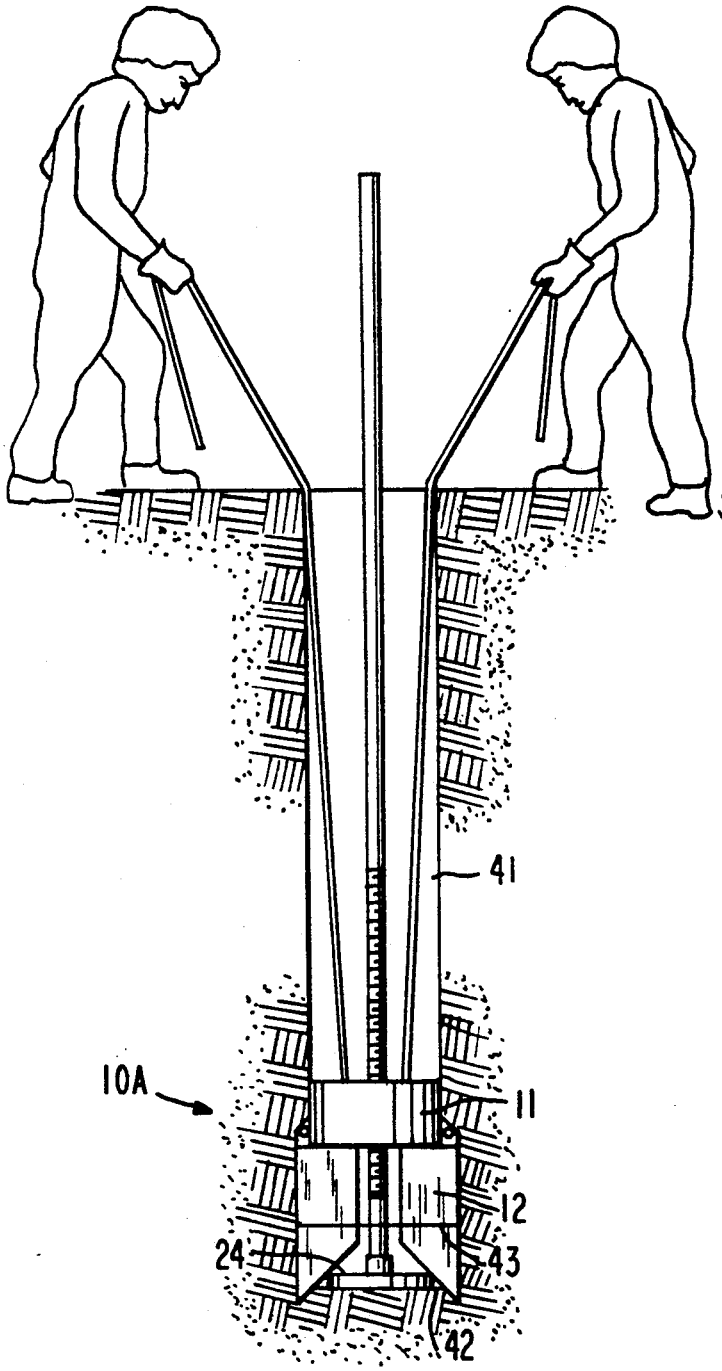
Figure 7:
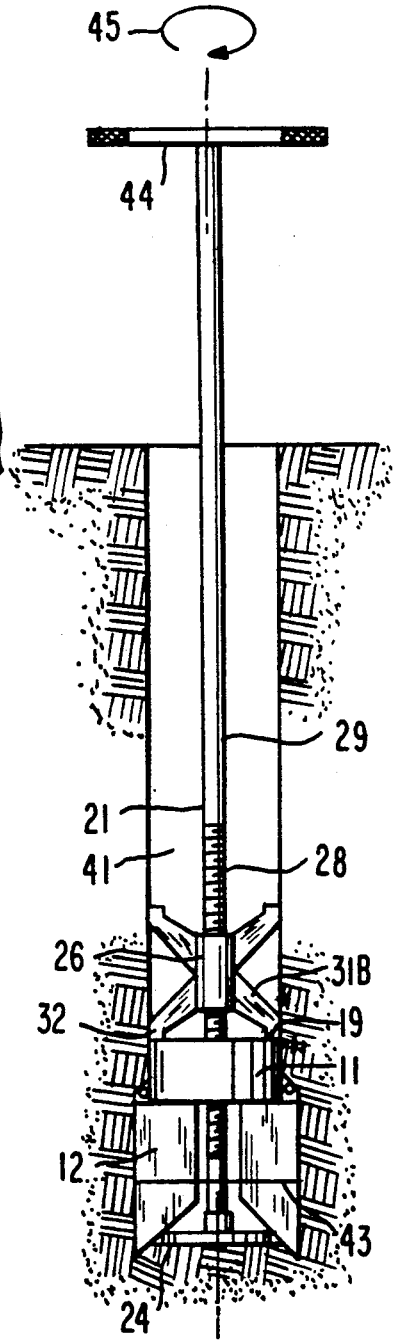

The method for the installation of the pole or post support is illustrated sequentially in FIGS. 4 through 11. A standard soil drilling instrument 40 is utilized to bore a hole 41 (FIG. 4) of a predetermined depth and diameter into the ground using known techniques. The deployment shaft 21, with the lower camming plate 24 and the camming plate bearing assembly 25, is lowered as a unit into the hole 41 (FIG. 5) where it comes to rest on the bottom 42. A first or lower collar assembly 10A is lowered into the hole 41 with the blades 12 pointing downwardly and aligned in the direction specified by the work plan (FIG. 6). A strapping 43 or other suitable temporary restraining means may be used to maintain the blades 12 in their installation position P1. The collar assembly 10A comes to rest at or near the bottom 42 of hole 41 when the blades 12 contact the lower camming plate 24 as shown in FIG. 6. The blade actuating means 26 is then slid down the unthreaded portion 29 of the deployment shaft 21. The shaft 21 is rotated in a first direction 45 by detachable rotation means 44 causing the internal threads of the blade actuating device 26 to engage with the threaded portion 28 of the deployment shaft 21. It may be necessary at this point to restrain the blade actuating device 26 from rotating with the shaft 21 in order to permit its axial translation downward towards the first collar assembly 10A until the tips 32 of the fingers 31B engage in tab slots 19 of the collar 11 (FIG. 7). The subsequent combination of the screw action on the blade actuating device 26 and the camming provided by the lower camming plate 24, results in the breakage of the strapping 43, if provided, and the extension of the blades 12 into the walls of the hole 41.

Figure 8:
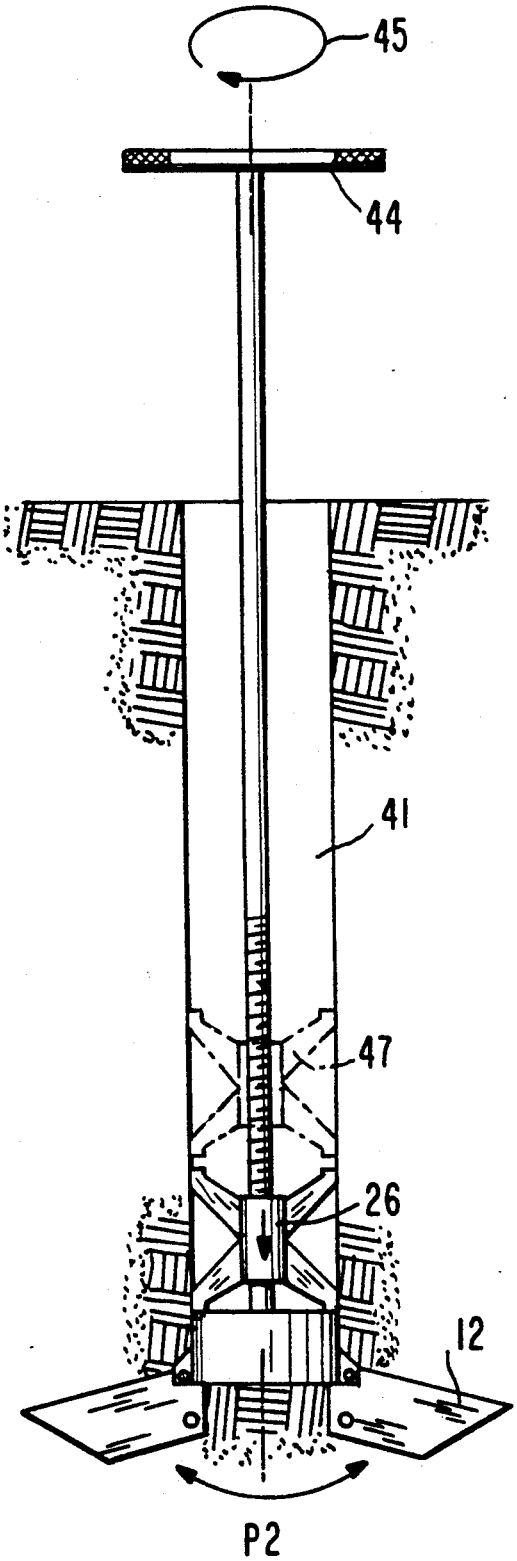

FIG. 8 demonstrates how the blade actuating device 26 moves from the collar contact position 47 down near to the base of the hole 41, resulting in the blades 12 attaining their deployed position P2. The rotation means 44 may then be removed. Although the rotation means 44 as shown in the drawings depicts a manually operated dual ratchet arm, the purpose could be served equally as well by appropriate power-assisted means.

Figure 9:
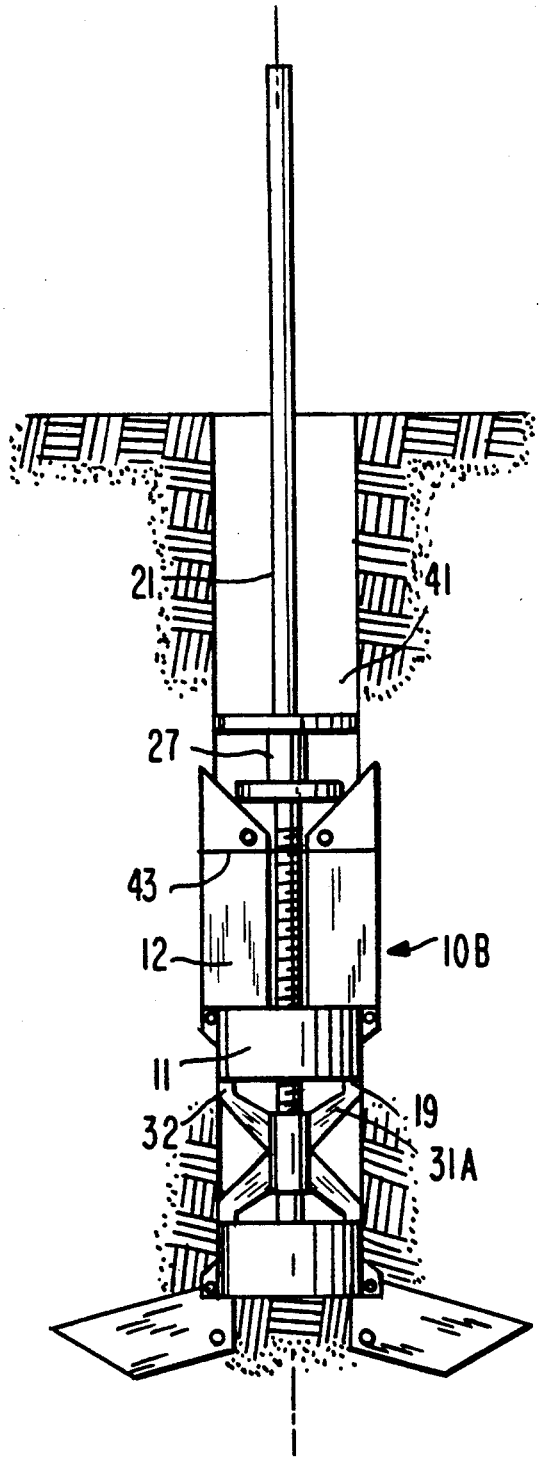
Figure 10:
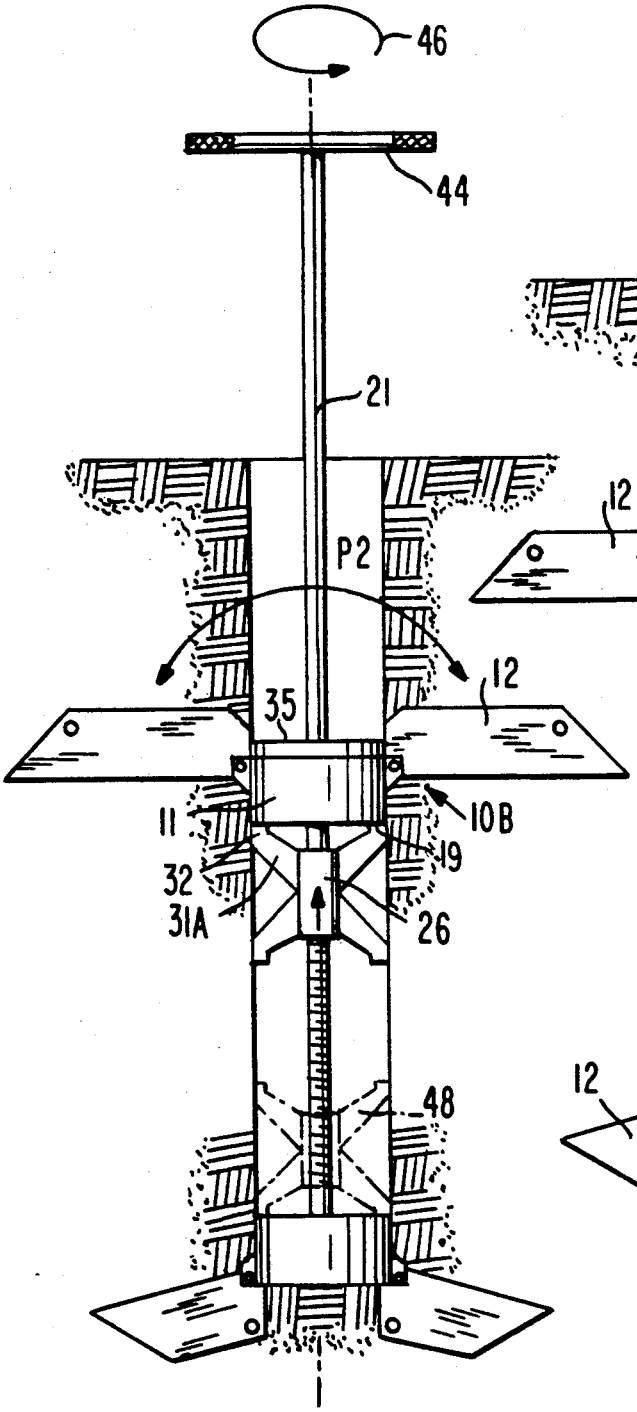

A second or upper collar assembly 10B is lowered into the hole 41 with the blades 12 pointing upwardly and aligned in the direction specified by the work plan (FIG. 9). A strapping 43 or other suitable temporary restraining means may be used to maintain the blades 12 in their installation position P1. The collar assembly 10B comes to rest with the tips 32 of fingers 31A engaged in tab slots 19 of collar 11 of the upper collar assembly 10B. The upper camming plate assembly 27 is slid down the deployment shaft 21 and is locked into position at a predetermined height. The shaft 21 is rotated in a second direction 46 by detachable rotation means 44 (FIG. 10). It is possible that, depending upon the height at which the upper camming plate assembly 27 is locked, there may exist a distance between the initial point of contact of blades 12 and the upper camming plate 34. If this is the case, then the rotation of the shaft 21 in the second direction 46 will result in the blade actuating device 26 moving upwards from its lowermost position 4B bringing with it upper collar assembly 10B, until the blades 12 contact the upper camming plate 34. The subsequent combination of screw action on the blade actuating device 26 and the camming provided by the upper camming plate 34, results in the breakage of the strapping 43, if provided, and the extension of the blades 12 into their deployed position P2. The purpose of the collar bearing plate 35 is to prevent the collar 11 of the collar assembly 10B from surpassing the point at which the blades 12 become generally perpendicular to the longitudinal axis of the collar 11, i.e., their P2 position. This purpose could be served equally as well by providing a means on the collar assembly 10B to prevent the blades 12 from rotating more than 90° from their P1 position.

Figure 11:
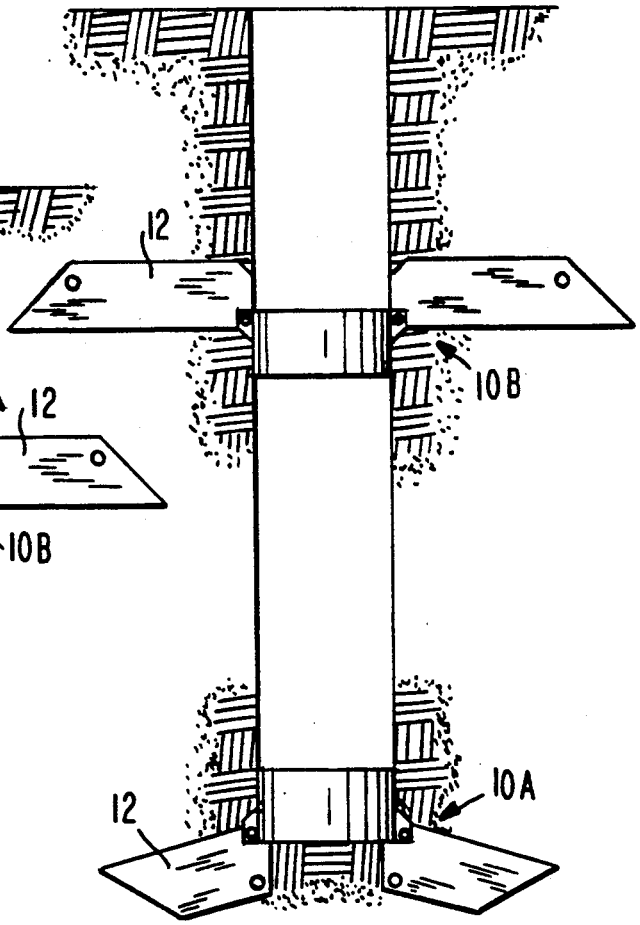

A slight counter-rotation of the shaft 21, i.e. in the first rotation direction 45, disengages the tips 32 of fingers 31A from the tab slots 19 in the collar 11. Further rotation of the shaft 21 in this direction 45 causes the finger pairs 31 to become misaligned with the tabs 18 of the second collar assembly 10B, thus permitting removal of the entire installation tool 20 (FIG. 11).

When wooden pole or post structures are used, it may be necessary, depending upon load factors, to attach bearing plates 51, 52 (FIG. 12C) to the pole to prevent the collapse of the wood fibres at the points of contact with the lower and upper collar assemblies 10A, 10B. In such case, one bearing plate 52 may be fitted to the pole 50 at the height of the upper collar assembly 10B and another bearing plate 51 may be fitted to the foot of the pole 50 located at the lower collar assembly 10A level. These bearing plates 51, 52 are attached before the pole 50 is lowered into the hole 41. It should be noted that various methods may be used to enhance the useful load of wooden pole structures. These, however, go beyond the scope of the present invention and, therefore, will not be discussed herein.

Figure 12A:
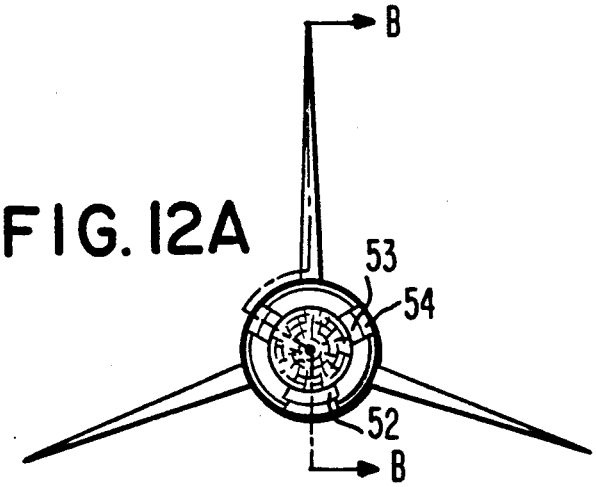
FIGS. 12A through 12C are views which illustrate the installation of a pole within the support and an adjusting and positioning means therefor.
Figure 12C:
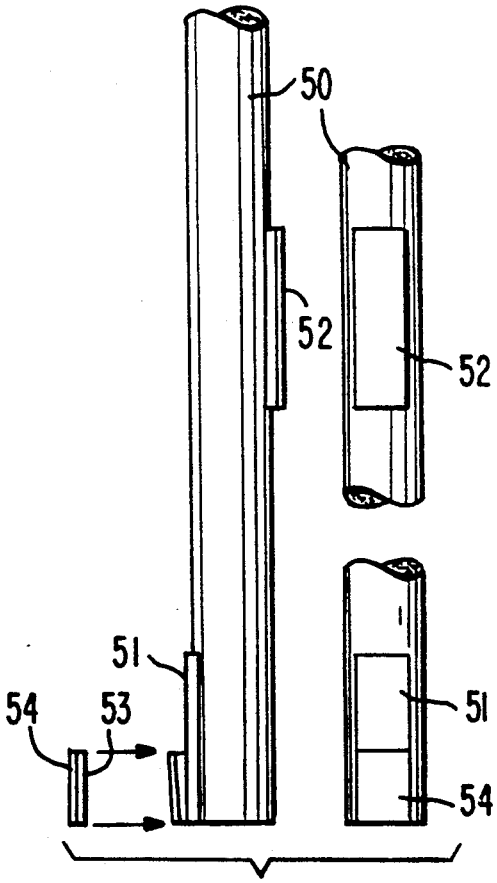
Figure 12B:
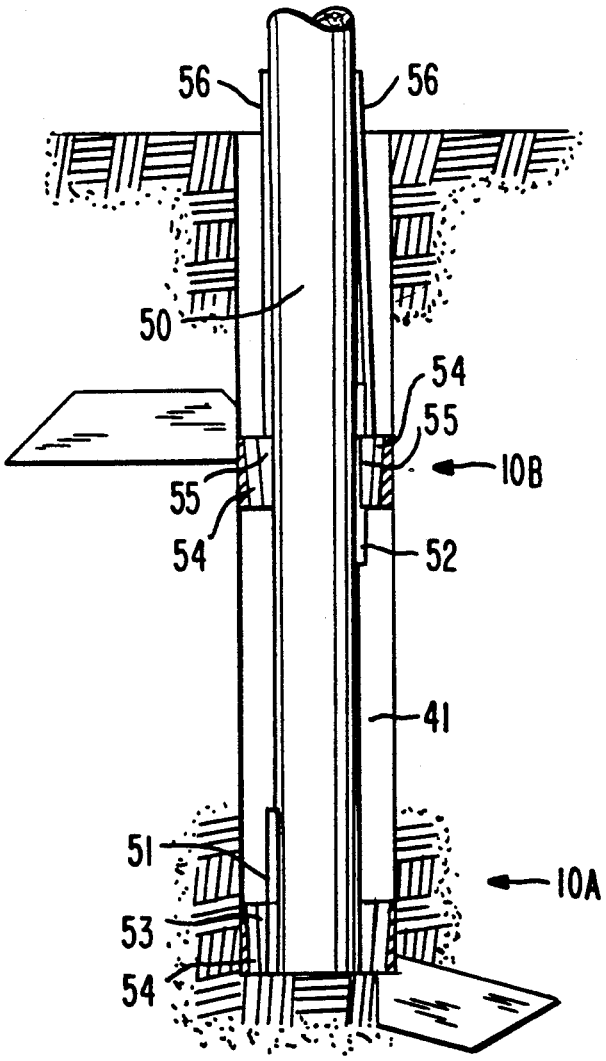

In order to ensure a proper fit, a plurality of adjustment wedges 53 and spacer blocks 54 are attached to the foot of the pole 50 prior to being lowered, so that the pole may sit firmly inside the lower collar assembly 10A (FIGS. 12A and 12B). Once the desired position of the pole 50 is obtained, the portion of the pole 50 at the level of the upper collar assembly 10B is locked into position using a plurality of adjustable positioning wedges 55 and spacer blocks 54. The adjustable positioning wedges 55 have extensions 56 that are fixed in place at ground level and thus remain accessible if ever it becomes necessary to readjust the position of the pole 50. The hole 41 is then back-filled with any desired material, which may include the original soil, using standard refilling techniques.

Figure 13:
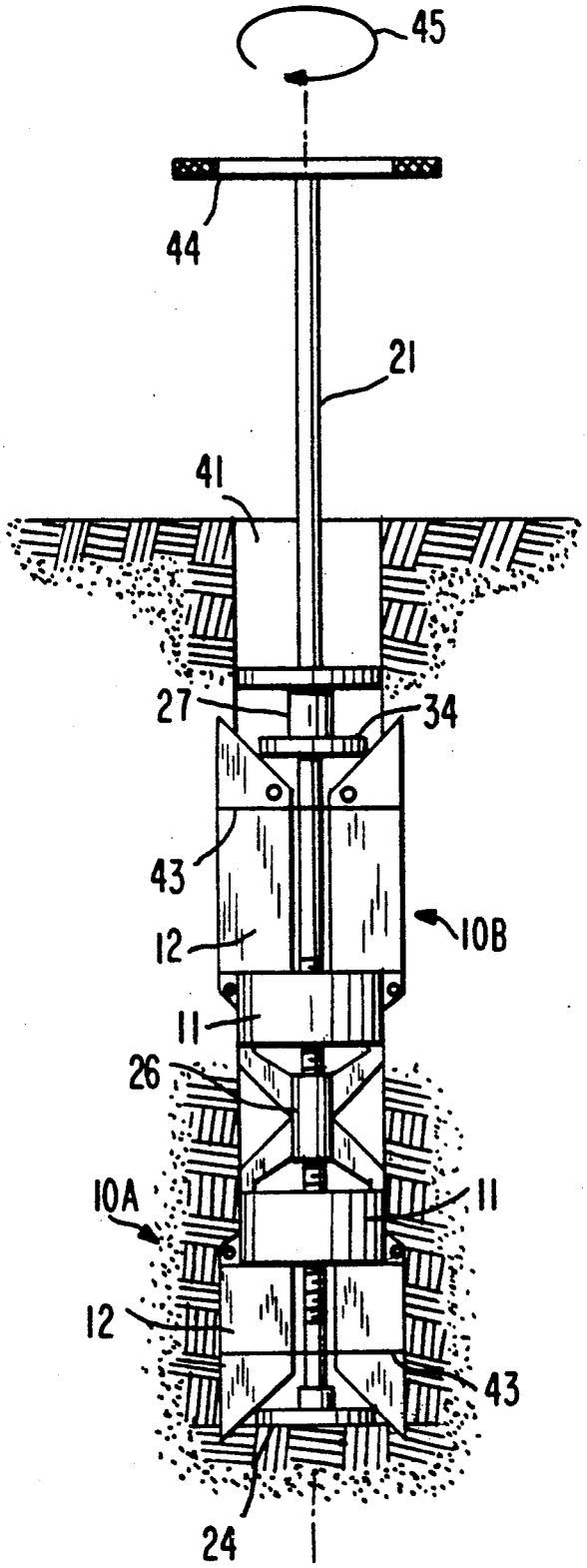
FIG. 13 is a side view illustrating an alternate method of installing the pole support.

In an alternate method of installing the support, the entire system, i.e. the collar assemblies 10A, 10B and the installation instrument 20, may be assembled at ground level and lowered as a unit into the hole 41, as shown in FIG. 13. In this arrangement, it is possible that the upper camming plate assembly 27 may not yet be locked into position since it may be prevented from sliding down the unthreaded portion 29 of the deployment shaft 21, to the predetermined height at which it is to be locked, by the position P1 of the blades 12 of the upper collar assembly 10B.

Rotation of the shaft 21 in a first direction 45 will cause the blade actuating device 26 to extend the blades 12 of the lower collar assembly 10A into the walls of hole 41 as described above. If not already locked into position, the downward displacement of the blade actuating device 26, and hence the upper collar assembly 10B, will be sufficient as to allow the upper camming plate assembly 27 to slide down on the unthreaded portion 29 of the shaft 21 until it locks into position at the predetermined height. Subsequent rotation of the shaft 21 in the opposite direction 46 deploys the blades 12 of the upper collar assembly 10B as described above and is illustrated in FIG. 10. The removal of the installation instrument is also as described above.

Certain advantages arise when installing the support in accordance with this method. Since the finger tips 32 are engaged in their appropriate slots 19 in the collars 11 when the unit is assembled at ground level, the need to align and engage the finger tips 32 in the slots 19 while the blade actuating device 26 is moving and is in the hole 41 where it might be difficult to see is eliminated. In addition, the presence of the upper collar device assembly 10B will prevent the blade actuating device 26 from rotating with the shaft 21 thereby avoiding the possibility of having to restrain its rotation by some other means. Such advantages may provide for shorter installation times thus increasing productivity.

Although using the alternate method with the arrangement exactly as shown in FIG. 13 will result in the blades 12 of the upper collar assembly 10B being deployed in substantially the same directions relative to the blades 12 of the lower collar assembly 10A, it is not intended that the blade deployment be so restricted. In most applications, it will be desired to deploy the blades of the upper and lower collar assemblies 10B, 10A offset relative to one another. It will be appreciated that various modifications to the apparatus may be affected in order to achieve this result. One such modification envisioned is to have the upwardly extending fingers 31A of the blade actuating device 26 being selectively and lockingly rotatable with respect to the downwardly extending fingers 31B. The amount of offset between the fingers 31A and 31B would then correspond to the amount of offset between the blades of the upper and lower collar assemblies 10B, 10A when deployed.

While a preferred embodiment has been shown and described having an upper and a lower collar assembly, the invention is not necessarily limited thereto and various modifications and substitutions may be made without departing from the spirit and scope of the invention as defined in the claims.

What is claimed is:

1. A support installation system for the subterranean support of poles or posts, comprising:

support means including a lower collar assembly and an upper collar assembly, each of said collar assemblies comprising a generally cylindrical collar having an axial throughbore adapted to receive therethrough a pole or post to be supported, each collar having a plurality of ground engageable blades pivotally connected thereto and initially in a non-ground engaging installation position; and a removable installation instrument comprising a deployment shaft carrying a blade extending means, said installation instrument being positionable to extend through said axial throughbores in said upper and lower collars, said blade extending means including deploying means engageable with said upper and lower collars and operable to cause said blades to extend, thereby to deploy said blades generally radially of their corresponding collars, said installation instrument being removable from said throughbores after installation to leave said collars in position to receive and support poles or posts.

2. A support installation system as claimed in claim 1, wherein said blades are pivotable between said installation position wherein said blades are generally parallel to a longitudinal axis of said collars, and a deployment position, wherein said blades are generally perpendicular to said axis of said collars.

3. A support installation system as claimed in claim 2, wherein said blade extending means further comprises a camming means, said deploying means including means for forcing said blades against said camming means to deflect said blades from said installation position to said deployment position.

4. A support installation system for the subterranean support of poles or posts, comprising:

a support including a lower and an upper collar assembly, each of said collar assemblies comprising a generally cylindrical collar having an axial throughbore adapted to receive therethrough a pole or post to be supported, each collar having a plurality of ground engageable blades pivotally connected thereto, said blades being pivotable between an installation position wherein the blades are generally parallel to a longitudinal axis of said collars and a deployment position wherein said blades are generally perpendicular to said axis of said collars; and an installation instrument comprising a deployment shaft positionable through said axial throughbores and including a threaded portion and an unthreaded portion, said threaded portion of said shaft being of greater diameter than said unthreaded portion, said instrument further including camming means and blade extending means carried by said deployment shaft, said blade extending means being operable to force said blades against said camming means to deflect said blades form said installation position to said deployment position.

5. A support installation system for the subterranean support of poles or posts comprising:

a support comprising a lower and an upper collar assembly, each assembly comprising a generally cylindrical collar having an axial throughbore adapted to receive a pole or post therethrough and having a plurality of ground engageable blades pivotally connected thereto, said blades being pivotable between an installation position, wherein said blades are generally parallel to the longitudinal axis of said collar, and a deployment position, wherein said blades are generally perpendicular to said axis of said collar; and an installation instrument insertable through said axial throughbores of said upper and lower collars, said instrument comprising a partially threaded deployment shaft having blade extending means comprising camming means and means engaging said deployment shaft for forcing said blades against said camming means to deflect said blades from said installation position to said deployment position, when said installation instrument is positioned through said axial throughbores, said installation instrument being removable from said throughbores after deployment of said blades.

6. A support installation system as claimed in claim 5, wherein said means for forcing said blades against said camming means comprises a blade actuating device being engageable with a threaded portion of said shaft, whereby rotation of said shaft causes said blade actuating device to move linearly along a longitudinal axis of said shaft.

7. A support installation system as claimed in claim 6, wherein said blade actuating device is engageable with said collar assemblies.

8. A support installation system as claimed in claim 7, wherein said blade actuating device comprises a plurality of fingers extending outwardly from a generally cylindrical body member, and wherein said collars further comprise a corresponding plurality of inwardly extending tabs with radial slots therein; each of said fingers including a finger tip adapted to be received in a portion of said slot of said corresponding tab.

9. A support installation system as claimed in claim 8, wherein the radial distance to which said fingers extend is less than the inner diameter of said collars.

10. A support installation system as claimed in claim 9, wherein said camming means comprises a lower and an upper camming plate assembly corresponding to said lower and upper collar assemblies.

11. A support installation system as claimed in claim 10, wherein said lower camming plate assembly comprises a lower camming plate and a camming plate bearing assembly, said camming plate bearing assembly being rigidly attached to said deployment shaft.

12. A support installation system as claimed in claim 11, wherein said upper camming plate assembly comprises a hollow cylindrical body portion having an upper camming plate and a collar bearing plate connected thereto, said body portion being slidable on said unthreaded portion of said deployment shaft.

13. A support installation system as claimed in claim 12 further comprising a locking means by which said upper camming plate assembly may be locked into a predetermined position against translation on said unthreaded portion of said deployment shaft.

14. A support installation system as claimed in claim 13, wherein said installation instrument further comprises means by which said deployment shaft may be rotated.

15. A support installation system as claimed in claim 9, wherein said blade actuating device comprises a generally cylindrical body member having attached thereto a plurality of outwardly and upwardly extending fingers and a plurality of outwardly and downwardly extending fingers, and wherein said upper and lower collar assemblies each further comprise a corresponding plurality of inwardly extending tabs with radial slots therein; each of said upwardly extending fingers including a finger tip adapted to be received in a portion of said slot of said corresponding tab on said upper collar assembly, and each of said downwardly extending fingers including a finger tip adapted to be received in a portion of said slot of said corresponding tab on said lower collar assembly.

16. A support installation system as claimed in claim 15, wherein said upwardly extending fingers are selectively and lockingly rotatable relative to said downwardly extending fingers.

17. A support installation system for the subterranean support of poles or posts comprising:

support means including at least one collar assembly, said at least one collar assembly comprising a generally cylindrical collar having an axial throughbore adapted to receive a pole or post therethrough, and having a plurality of ground engageable blades pivotally connected thereto; and an installation instrument comprising a deployment shaft having blade extending means associated therewith, said installation instrument being positionable through said throughbore of said at least one collar and when so positioned being operable to extend said blades generally radially of said at least one collar, said installation instrument being removable from said throughbore after radial extension of said blades whereby said collar assembly can receive and support a pole or post.

18. A method for the installation of underground supports for poles and posts, of the type comprising an upper and a lower collar assembly each including a collar having a plurality of ground engageable blades pivotally connected thereto, and utilizing an installation instrument of the type comprising means to extend generally radially the blades of said collar assemblies by rotating said instrument, comprising the steps of:

boring a hole of predetermined depth and diameter into the earth;

assembling on said installation instrument said upper and lower collar assemblies to form a unit;

lowering said unit into said hole:

rotating said installation instrument in a first direction to extend said blades of said lower collar assembly into the earth;

19. A method for installing poles and posts using a support installation system of the type comprising a support and an installation instrument, said support including an upper and a lower collar assembly each having a plurality of ground engageable blades pivotally connected thereto, said support further including pole positioning and adjusting means and said installation instrument having means to extend generally radially said blades of said collar assemblies, comprising the steps of:

boring a hole of predetermined depth and diameter into the earth;

assembling on said installation instrument said upper and lower collar assemblies to form a unit;

lowering said unit into said hole;

actuating said blade extending means of said installation instrument to extend said blades of said lower collar assembly into the earth:

actuating said blade extending means of said installation instrument to extend said blades of said upper collar assembly into the earth;

removing said installation instrument;

lowering said pole or post into said hole and said support, adjusting and positioning said pole or post using pole positioning and adjusting means; and back-filling the remaining portion of said hole.

20. A method for the installation of underground supports for poles and posts, of the type consisting of a lower and an upper collar assembly each comprising a collar having a plurality of blades pivotably connected thereto, and utilizing an installation instrument, said installation instrument comprising a deployment shaft having associated therewith lower and upper camming means and means engageable with said deployment shaft for forcing said blades of said lower and upper collar assemblies against said respective lower and upper camming means upon rotation of said deployment shaft to deflect said blades of said collar assemblies generally radially; the method comprising the steps of:

boring a hole of predetermined depth and diameter into the earth;

inserting said deployment shaft into said hole, said deployment shaft having said lower camming means attached thereto;

lowering said lower collar assembly into said hole;

engaging said blade forcing means on said deployment shaft;

rotating said deployment shaft to extend said blades of said lower collar assembly into the earth;

lowering said upper collar assembly into said hole;

lockingly engaging said upper camming means on said deployment shaft;

rotating said deployment shaft to extend said blades of said upper collar assembly into the earth; and removing said installation instrument.

21. A method for installing poles or posts using a support installation system of the type comprising a support and an installation instrument, said support including a lower and an upper collar assembly each having a plurality of ground engageable blades pivotally connected thereto, said support further including pole positioning and adjustment means, said installation instrument including a deployment shaft having associated therewith lower and upper camming means and means engageable with said deployment shaft for forcing said blades of said lower and upper collar assemblies against said respective lower and upper camming means to deflect said blades of said collar assemblies generally radially; the method comprising the steps of:

boring a hole of predetermined depth and diameter into the earth;

inserting into said hole said deployment shaft having said lower camming means attached thereto;

lowering said lower collar assembly into said hole;

engaging said blade forcing means on said deployment shaft;

actuating said blade forcing means to extend said blades of said lower collar assembly into the earth;

lowering said upper collar assembly into said hole;

actuating said blade forcing means to extend said blades of said upper collar assembly into the earth;

removing said installation instrument;

lowering said pole or post into said hole and said support;

adjusting and positioning said pole or post into proper position using said pole positioning and adjustment means; and back-filling the remaining portion of said hole.

22. A support installation system for the subterranean support of a pole or post, comprising:

a support and an installation instrument;

said supporting including a lower and an upper collar assembly, each of said collar assemblies comprising a generally cylindrical collar having a plurality of ground engageable blades pivotally connected thereto and having an axial throughbore adapted to receive said pole or post therethrough; and said installation instrument being removably insertable through said throughbores and including deployment means moveable with respect to said collars of said collar assemblies and being operable to extend said blades of each of said collars generally radially of said installation instrument, said installation instrument being thereafter removable from said throughbores to leave said collars in place to receive and support said pole or post.

* * * * *

UNITED STATES PATENT AND TRADEMARK OFFICE

CERTIFICATE OF CORRECTION

PATENT NO. : 5,108,068

DATED : April 28, 1992

INVENTOR(S) : Gingras

It is certified that error appears in the above-identified patent and that said Letters Patent is hereby corrected as shown below:

Claim 4, column 7, line 33, "form" should be --from--.

Claim 18, column 9, line 23, after "into the earth;" insert

-- rotating said installation instrument in a second direction to extend said blades of said upper collar assembly into the earth; and removing said installation instrument.--

Signed and Sealed this

Third Day of August, 1993

*Attest:*

Michael K. Kirk

MICHAEL K. KIRK

*Attesting Officer*

*Acting Commissioner of Patents and Trademarks*